US008020392B2

(12) United States Patent
Konopa et al.

(10) Patent No.: US 8,020,392 B2
(45) Date of Patent: Sep. 20, 2011

(54) REFRIGERATING APPLIANCE

(75) Inventors: Helmut Konopa, Leipheim (DE); Wolfgang Nuiding, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 756 days.

(21) Appl. No.: 10/592,970

(22) PCT Filed: Mar. 14, 2005

(86) PCT No.: PCT/EP2005/051136
§ 371 (c)(1),
(2), (4) Date: Jun. 25, 2008

(87) PCT Pub. No.: WO2005/090878
PCT Pub. Date: Sep. 29, 2005

(65) Prior Publication Data

US 2008/0250799 A1 Oct. 16, 2008

(30) Foreign Application Priority Data

Mar. 15, 2004 (DE) ..... 10 2004 012 498

(51) Int. Cl.

| | |
|---|---|
| ***F25D 21/00*** | (2006.01) |
| ***F25D 21/06*** | (2006.01) |
| ***F25D 21/14*** | (2006.01) |
| ***F25B 47/00*** | (2006.01) |

(52) U.S. Cl. ..... 62/150; 62/275; 62/279; 62/291

(58) Field of Classification Search ..... 62/150, 62/275, 277, 279, 280, 285, 291; 392/441; 312/404
See application file for complete search history.

(56) References Cited

U.S. PATENT DOCUMENTS

| | | | | |
|---|---|---|---|---|
| 2,315,222 | A * | 3/1943 | Philipp | 62/289 |
| 5,545,878 | A | 8/1996 | Jasper, II et al. | |

FOREIGN PATENT DOCUMENTS

| | | | |
|---|---|---|---|
| DE | 198 55 504 | | 6/2000 |
| DE | 102 08 558 | | 9/2003 |
| JP | 08035757 | A * | 2/1996 |
| JP | 8 271120 | | 10/1996 |
| JP | 08271120 | A * | 10/1996 |
| JP | 2003 130535 | | 5/2003 |
| JP | 2003 279229 | | 10/2003 |

OTHER PUBLICATIONS

International Search Report PCT/EP2005/051136, 2005.

* cited by examiner

*Primary Examiner* — Chen Wen Jiang
(74) *Attorney, Agent, or Firm* — James E. Howard; Andre Pallapies

(57) ABSTRACT

A refrigerating appliance comprising a storage compartment, a refrigerant circuit which serves to cool the storage compartment and contains a compressor, and comprising a collecting receptacle for condensed water flowing out of the storage compartment. The collecting receptacle can be heated by a heating device that can be independently operated by the operation of the compressor.

11 Claims, 2 Drawing Sheets

REFRIGERATING APPLIANCE

This invention relates to a refrigerating appliance with a collecting or evaporation receptacle for condensed water. A refrigerating appliance is disclosed in DE 198 55 504 A1. This refrigerating appliance of prior art has a heat insulating housing which encloses a storage compartment for goods to be refrigerated and has, in a lower corner, a recess open towards the outside in which a compressor is installed for a refrigerant circuit of the refrigerating appliance. A collecting receptacle is mounted on the compressor housing for condensed water which condenses in the storage compartment and flows out through an opening formed above the collecting receptacle in the housing into the collecting receptacle.

The collecting receptacle is mounted on the compressor housing in order to utilise loss heat which the compressor generates during operation, and to heat the condensed water in the collecting receptacle, thereby accelerating its evaporation.

In recent years considerable efforts have been made to reduce the energy consumption of refrigerating appliances, as a result of which the power input which the compressor must have in order to cool the storage compartment effectively is being increasingly reduced with advanced development. In modern refrigerating appliances with high quality insulation it may therefore happen that the waste heat from the compressor is no longer sufficient to evaporate the condensed water at the rate at which it flows out of the storage compartment, so that the collecting receptacle eventually overflows. If the overflowing condensed water reaches live parts below the drip tray, damage to the electrics of the refrigerating appliance may result. Condensed water escaping from the appliance may also lead to damage elsewhere, particularly in the case of built-in appliances which are provided for installation in kitchen cabinets. Problems of this kind may arise, particularly in the case of self-defrosting appliances in which the condensed water is produced in pulses in large quantities.

The object of this invention is to provide a refrigerating appliance in which overflowing of the collecting tray can be reliably avoided, even if waste heat discharged from the compressor to the drip tray is low.

The object is achieved by a refrigerating appliance with the features of the claims. The heating power supplied to the collecting tray can be supplemented by means of the independent heating device to the extent required to prevent overflowing.

The heating device is preferably formed essentially by an ohmic resistance.

The heating device can be arranged simply on a wall of the collecting receptacle; in order to introduce the thermal energy discharged by it into the condensed water contained in the collecting receptacle with the lowest possible loss, the heating device is preferably arranged so that it is immersed in the collecting receptacle.

A control circuit may be provided for operating the heating device periodically. If the ratio of the operating time of the heating device to the total operating time of the refrigerating appliance can be adjusted on the control circuit, the mean heating power may always be limited to the minimum required to prevent overflow, according to the climatic conditions under which the refrigerating appliance is used.

According to a preferred embodiment a door opening sensor is provided on a door of the refrigerating appliance, and a control circuit connected to the door opening sensor controls the average power of the heating device according to the frequency of the recorded door openings. This embodiment is based on the consideration that a certain quantity of moisture is introduced into the refrigerating appliance whenever the door is opened due to the air exchange between the storage compartment of the refrigerating appliance and its surroundings, and that this moisture eventually reaches the collecting receptacle as condensed water, and must be evaporated from it so that the heat energy required for this must be supplied.

According to a particularly economic embodiment a water level sensor is arranged on the collecting receptacle and a control circuit connected to the water level sensor operates the heating device if the water level recorded by the water level sensor exceeds a limit value. In this embodiment heat energy is actually only expended when this is required to prevent overflow; here there are no safety margins which are required in the case of purely time-controlled operation of the heating device or operation of the heating device controlled on the basis of the frequency of the door openings in order to allow for fluctuations in the climatic conditions or the emission of moisture by goods to be refrigerated and stored in the refrigerating appliance.

The water level sensor is preferably formed by a float switch.

Further features and advantages of the invention are explained in the following description of exemplary embodiments, with reference to the attached figures, where:

Figure 1:
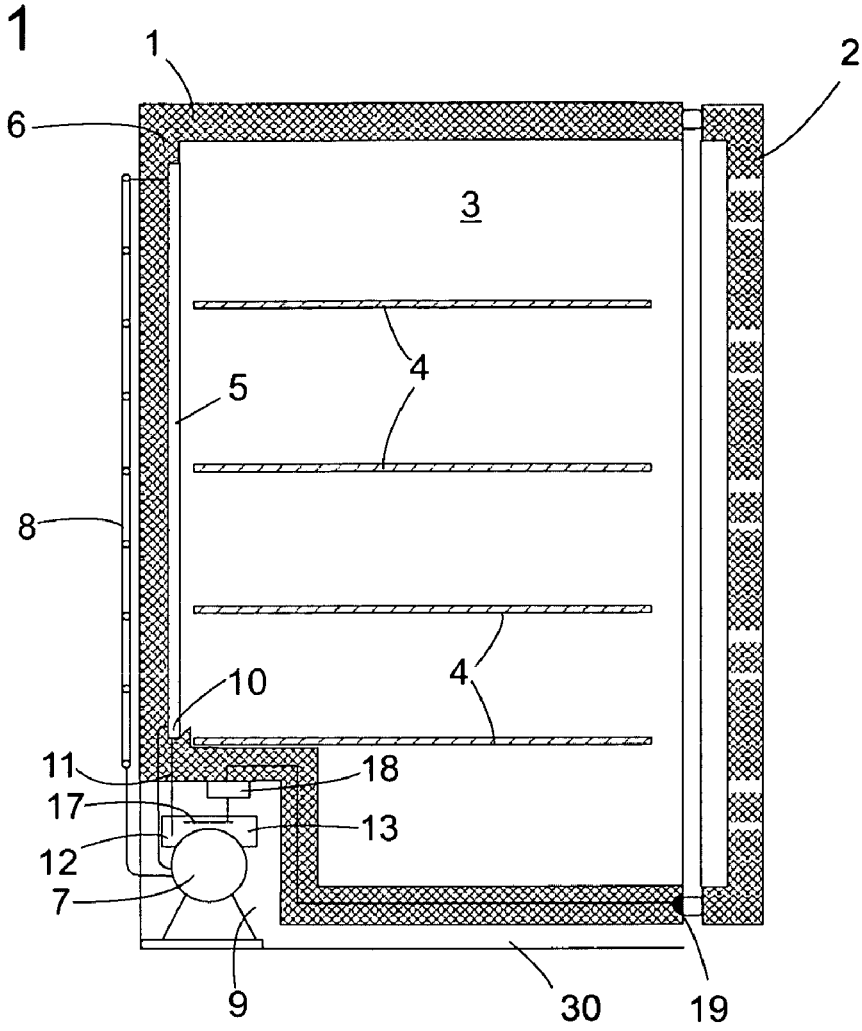
FIG. 1 shows a diagrammatic section through a refrigerating appliance according to the invention.

The refrigerating appliance shown diagrammatically in FIG. 1 in section comprises a heat insulating housing with a body 1 and a door 2 articulated to it, which enclose a storage compartment 3. An evaporator 5 is arranged on the rear side of storage compartment 3 divided into drawers by a plurality of draw bottoms 4. Here evaporator 5 is represented as a plate-shaped body which is inserted between a wall of the insulating receptacle of body 1 bounding interior space 3, and an insulating foam filling 6. A refrigerant circuit extends from a high pressure outlet of a compressor 7 via a liquefier 8 fitted on the outside of the rear of body 1 and evaporator 5 to a suction connection of compressor 7. Compressor 7 is installed in a recess 9 close to the bottom on the rear side of body 1 below evaporator 5.

Air moisture from interior space 3, which condenses on its wall cooled by evaporator 5, is accumulated on the lower edge of this wall in a gutter 10 and is fed from there via a drain pipe 11 guided through foam filling 6 to a bowl-shaped collecting receptacle 12, which is mounted on compressor 7 in order to be heated by its waste heat.

The air moisture produced by evaporation from collecting receptacle 12 in recess 9 is flushed away by an air flow which, driven by the heat discharged by liquefier 8 in a flue between the rear wall of body 1 and an opposing cabinet or building wall, not shown, runs firstly through an intake duct 30 guided along the bottom of body 1, then through recess 9 and finally via the flue and into the open air.

Figure 2:
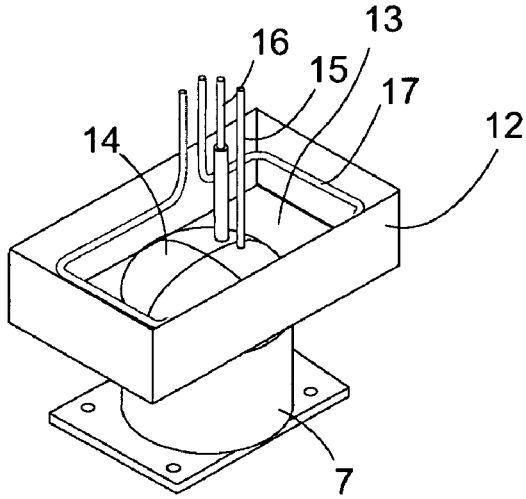
FIG. 2 shows a compressor with a collecting receptacle mounted therein, according to a first embodiment of the invention.

FIG. 2 shows a perspective view of a special embodiment of the upper section of compressor 7 and collecting receptacle 12 mounted on it. Here collecting receptacle 12 has in its bottom 13 an opening into which an upper section of the housing of compressor 7 is inserted so that it is sealed. The water in collecting receptacle 12 therefore comes into direct contact with the housing of compressor 7, so that the waste heat discharged by compressor 7 in operation is absorbed with high efficiency from the condensed water.

By inserting upper housing section 14 directly into bottom 13 it is possible, as shown in FIG. 2, unlike the diagrammatic representation in FIG. 1, to lead a pressure connection 15 and suction connection 16 of compressor 7 through collecting receptacle 12 and condensed water contained in it. Suction connection 16, through which flows expanded, cold refrigerant coming from evaporator 5, is provided with an insulating jacket; pressure connection 15, through which flows compressed, warm refrigerant to liquefier 8, is not insulated, so that heat from the refrigerant can also be dissipated to the condensed water. To reinforce this effect a further pipe section (not shown in the figure) may be provided between pressure connection 15 and liquefier 8, which section runs in the manner of a loop or meanders through the condensed water.

An electrically operating heating rod 17 is immersed from above into collecting receptacle 12, and extends in it in the form of a loop. It is supplied with energy by a control circuit 18 (see FIG. 1).

According to a simple embodiment control circuit 18 comprises a timer, which switches heating rod 17 on and off for a fixed period. The proportion of the connection time of each period may in the simplest case also be fixed, since in the case of a refrigerator used in a hot environment, the quantity of liquid which is introduced into storage compartment 3 whenever the door is opened, and which must ultimately be evaporated in collecting receptacle 12, is indeed greater than in the case of a refrigerator used in a cold environment. At the same time, however, the proportion of the compressor running time of the total operating time of the refrigerator is also higher in a hot environment than in a cold one, with the result that more waste heat from compressor 7 is also available for evaporation. However, the length of operating phases 17 may also be adjusted on control circuit 18 to take account of the influence of the ambient climate, or other ambient factors that vary from one appliance to another, on the condensed water produced.

According to a second further developed embodiment a door opening sensor 19 is connected to control circuit 18. This sensor may, for example, be a magnetic field sensor subjected to the magnetic field of a magnetic seal of door 2, or simply a switch which is normally provided on each refrigerating appliance for switching the interior lighting of storage compartment 3 on and off, depending on the opening condition of door 2. Control circuit 18 counts the door opening processes recorded by this door opening sensor 19 and switches on heating rod 17 after a predetermined number of recorded door openings for a predetermined period of time which is preset by the manufacturer so that the waste heat from compressor 7, together with the quantity of heat given off by heating rod 17, would have to be sufficient to evaporate an estimated quantity of moisture introduced by the door openings.

Figure 4:
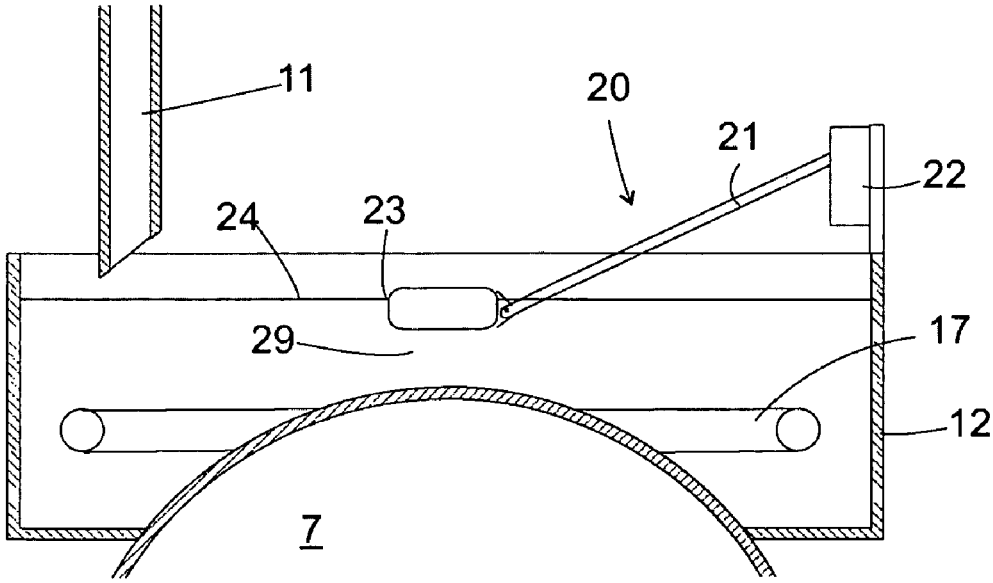
FIG. 4 shows a diagrammatic section through a collecting receptacle with a float switch.

In a third further developed embodiment sensor circuit 18 is instead connected to a door opening sensor with a water level sensor 20 fitted on collecting receptacle 12. FIG. 4 shows, in a diagrammatic section, collecting receptacle 12 provided with such a water level sensor 20. Water level sensor 20 is here designed as a float switch, with an electrical switch 22 that can be actuated by an elongated arm 21, and a floating body 23 immersed in the condensed water of collecting receptacle 12 fitted on the free end of arm 21. If the water level in collecting receptacle 12 exceeds a critical value, switch 22 closes and heating rod 17 is supplied with electrical energy until water level 24 drops below the critical value again.

Figure 3:
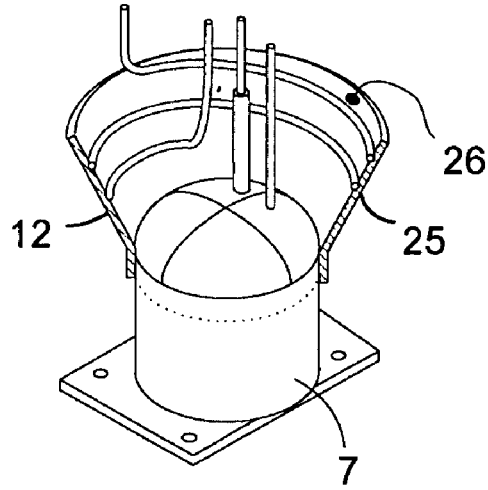
FIG. 3 shows a compressor with a collecting receptacle according to a second embodiment of the invention.

FIG. 3 shows a further embodiment of collecting receptacle 12 mounted on upper section 14 of the housing of compressor 7. Whilst upper housing section 14 is shown in a perspective view, collecting receptacle 12 is shown half in section in order to show a heating wire 25 which is fitted in a plurality of windings to the inner face of collecting receptacle 12. Since heating wire 25 is supported by collecting receptacle 12, it need not be as rigid as heating bar 17. Collecting receptacle 12 can here be provided on its outside with an insulation coating (not shown) to ensure that heat dissipated by heating wire 25 is fully absorbed by the condensed water in collecting receptacle 12 and is not lost to the surrounding atmosphere through the outer faces of collecting receptacle 12.

A temperature sensor 26 fitted to the inside of collecting receptacle 12, in the vicinity of heating wire 25, here serves as a sensor for the water level in collecting receptacle 12. When the heating wire is in operation the temperature recorded by temperature sensor 26 depends on whether it, and regions of heating resistance 25 adjacent to it, lie below the water level or not. If the temperature recorded by this sensor 26 during the operation of heating wire 25 exceeds an empirically established limit value, it may be concluded from this that these regions of heating wire 25 adjacent to temperature sensor 26 are not immersed in the condensed water, and that consequently it is not necessary to operate heating wire 25. In other words, in this embodiment a control circuit 18 connected to temperature sensor 26 can, from time to time, put heating wire 25 into operation for test purposes in order to evaluate the resistance in collecting receptacle 12 on the basis of the heating of temperature sensor 26, and if the evaluation indicates that the water level is not critical, the operation of heating wire 25 is interrupted again immediately. Otherwise its operation is continued, if necessary with an output that is higher than in the preceding test phase, until the water level has dropped below a critical value and this is reflected in a rise in the temperature recorded by sensor 26.

Such a temperature sensor 26 could also be secured directly to heating rod 17 in the embodiment shown in FIGS. 2 and 4. It is also conceivable to use heating wire 25 or heating rod 17 itself as a temperature sensor if its heating resistance has a temperature-dependent resistance value whose measurement by control circuit 18 indicates whether heating wire 25 or heating rod 17 has been cooled by condensed water or not.

The invention claimed is:

1. A refrigerating appliance comprising:

a storage compartment;

a door of the refrigerating appliance for opening and closing the storage compartment;

a refrigerant circuit cooling the storage compartment and including a compressor;

a collecting receptacle collecting condensed water from the storage compartment; and a heating device heating the collecting receptacle and being operated independently from the operation of the compressor;

a door opening sensor disposed adjacent the door and detecting the opening of the door; and a control circuit connected to the door opening sensor and structured to control the average power of the heating device in response to the frequency of the door openings detected.

2. The refrigerating appliance according to claim 1, wherein the heating device comprises an ohmic resistance.

3. The refrigerating appliance according to claim 1, wherein the heating device includes an electrically operated heating rod.

4. The refrigerating appliance according to claim 1, wherein the heating device is arranged on a wall of the collecting receptacle.

5. The refrigerating appliance according to claim 1, wherein the heating device is arranged so that it is immersed in the condensed water within the collecting receptacle.

6. The refrigerating appliance according to claim 1, wherein the door includes a magnetic seal and the door opening sensor includes a magnetic field sensor.

7. The refrigerating appliance according to claim 1, further comprising:

a water level sensor disposed on the collecting receptacle wherein the control circuit is further structured to control the heating device when the water level detected by the water level sensor exceeds a limit value.

8. The refrigerating appliance according to claim 7, wherein the water level sensor includes a float switch.

9. The refrigerating appliance according to claim 1, further comprising:

a time measuring device wherein the control circuit is further structured to control the heating device when a predetermined time is reached.

10. The refrigerating appliance according to claim 1, further comprising:

a temperature sensor disposed on the collecting receptacle wherein the control circuit is further structured to control the heating device in response to a temperature detected by the temperature sensor.

11. The refrigerating appliance according to claim 1, wherein the compressor includes a housing forming at least a portion of the collecting receptacle, condensed water within the collecting receptacle contacting the housing and absorbing waste heat from the compressor.

* * * * *